US012774530B2

(12) United States Patent
Hosokawa et al.

(10) Patent No.: US 12,774,530 B2
(45) Date of Patent: Oct. 27, 2026

(54) GROUNDING DEVICES FOR SUBSTRATE PROCESSING CHAMBERS

(71) Applicant: Applied Materials, Inc., Santa Clara, CA (US)

(72) Inventors: Aki Hosokawa, Sunnyvale, CA (US); Teng Mao Wang, Tainan City (TW)

(73) Assignee: Applied Materials, Inc., Santa Clara, CA (US)

( * ) Notice: Subject to any disclaimer, the term of this patent is extended or adjusted under 35 U.S.C. 154(b) by 765 days.

(21) Appl. No.: 17/950,012

(22) Filed: Sep. 21, 2022

(65) Prior Publication Data

US 2024/0093380 A1 Mar. 21, 2024

(51) Int. Cl.
*C23F 11/18* (2006.01)

(52) U.S. Cl.
CPC ..... *C23F 11/18* (2013.01)

(58) Field of Classification Search
CPC ..... C23F 11/18; C23C 16/50
See application file for complete search history.

(56) References Cited

U.S. PATENT DOCUMENTS

| | | | | |
|---|---|---|---|---|
| 7,972,470 | B2 | 7/2011 | Furuta et al. | |
| 8,381,677 | B2 * | 2/2013 | Park | H01J 37/32623 156/345.43 |
| 9,472,443 | B2 | 10/2016 | Rasheed et al. | |
| 10,159,141 | B2 * | 12/2018 | Su | H05K 1/0218 |
| 2008/0116876 | A1 | 5/2008 | White et al. | |
| 2011/0036709 | A1 * | 2/2011 | Hawrylchak | C23C 14/564 204/298.11 |
| 2018/0340258 | A1 | 11/2018 | Choi et al. | |
| 2020/0185203 | A1 * | 6/2020 | Lubomirsky | C23C 16/4586 |

FOREIGN PATENT DOCUMENTS

| | | | |
|---|---|---|---|
| CN | 205692970 | U * | 11/2016 |
| KR | 20090119341 | A | 11/2009 |
| KR | 20160127368 | A | 11/2016 |
| WO | 2014159222 | A1 | 10/2014 |
| WO | 2020222764 | A1 | 11/2020 |

OTHER PUBLICATIONS

Kim Kyung A et.al. [KR20160127368A] (Machine Translation) (Year: 2016).*
[KR102358059B1] (KR'059B hereafter) (Machine Translation) (FIG from original) (Year: 2021).*
J. Gilbert Kaufman ["Properties of Pure Aluminum", ASM Handbook, vol. 2A, Aluminum Science and Technology, p. 31-43] (Year: 2018).*
["INCONEL® alloy 693" Publication No. SMC-043 Copyright © Special Metals Corporation, 2005 (Feb. 2005)] (Year: 2005).*
Zhang Sihan et.al. [CN205692970U] (Machine Translation) (Year: 2016).*
International Search Report and Written Opinion for International Application No. PCT/US2023/033296, mailed Jan. 8, 2024, 10 Pages.

* cited by examiner

*Primary Examiner* — Sally A Merkling
*Assistant Examiner* — Nazmun Nahar Shams
(74) *Attorney, Agent, or Firm* — Lowenstein Sandler LLP

(57) ABSTRACT

A grounding strap for a process chamber includes a core layer. The grounding strap further includes an outer layer. The outer layer includes at least 99% aluminum.

7 Claims, 5 Drawing Sheets

GROUNDING DEVICES FOR SUBSTRATE PROCESSING CHAMBERS

TECHNICAL FIELD

Embodiments of the present disclosure relate, in general, to coatings for components of manufacturing equipment. More specifically, the present disclosure relates to corrosion resistant coating of grounding devices for process chambers.

BACKGROUND

Various manufacturing processes expose chamber components and their coating materials to high temperatures, high energy plasma, a mixture of corrosive gases, high stress, high strength electric fields, and combinations thereof. These extreme conditions may increase the components' and the coating materials' susceptibility to defects. Coatings are used which are effective at protecting chamber components from one or more of these damaging conditions. In some cases, a coating which protects against multiple conditions may be applicable to a particular component, chamber, process, etc.

SUMMARY

The following is a simplified summary of the disclosure in order to provide a basic understanding of some aspects of the disclosure. This summary is not an extensive overview of the disclosure. It is intended to neither identify key or critical elements of the disclosure, nor delineate any scope of the particular implementations of the disclosure or any scope of the claims. Its sole purpose is to present some concepts of the disclosure in a simplified form as a prelude to the more detailed description that is presented later.

In one aspect of the disclosure, a grounding strap for a process chamber includes a core layer and an outer layer. The core layer may be comprised of a first material and the outer layer may be comprised of aluminum. The outer layer may be comprised of at least 99% pure aluminum.

In another aspect of the disclosure, a process chamber includes a chamber body. The process chamber further includes a substrate support. The process chamber further includes a grounding device, coupled to the chamber body and the substrate support. The grounding device includes a core layer. The grounding device further includes an outer layer. The outer layer comprises at least 99% aluminum.

In another aspect of the disclosure, a method includes providing a grounding device for application of an outer coating. The method further includes depositing an outer layer on the grounding device. The outer layer comprises at least 99% aluminum.

BRIEF DESCRIPTION OF THE DRAWINGS

The present disclosure is illustrated by way of example, and not by way of limitation. It should be noted that different references to "an" or "one" embodiment in this disclosure are not necessarily to the same embodiment, and such references mean at least one.

DETAILED DESCRIPTION

Figure 1:
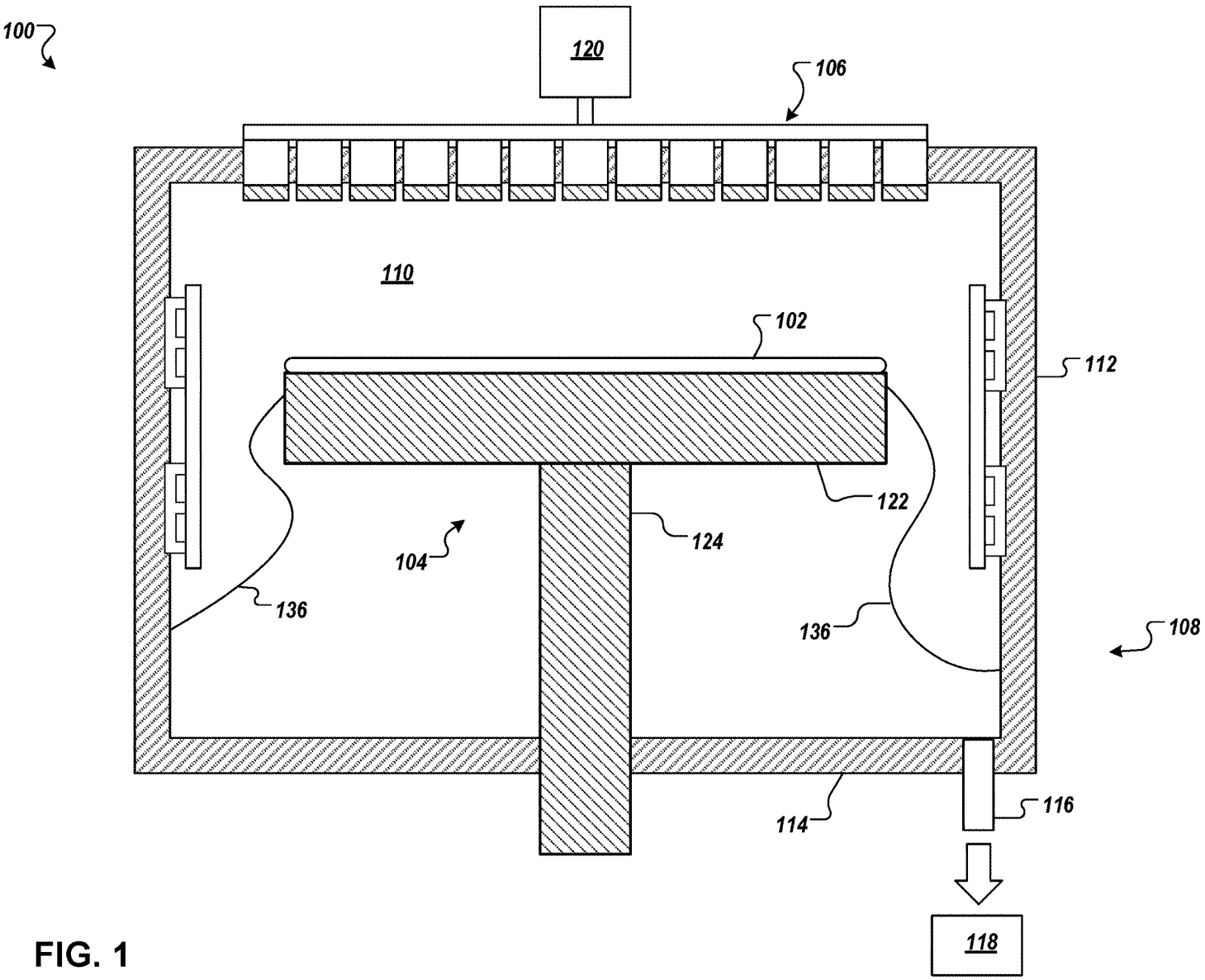
FIG. 1 is a sectional view of a processing chamber including multi-layered grounding devices, according to some embodiments.

Described herein are technologies related to providing protection to components of a manufacturing chamber by coating components in one or more resistant materials. Manufacturing equipment (e.g., processing chambers) is used to process substrates, such as semiconductor wafers. The properties of substrates are determined by the conditions in which the substrates were processed. Components of the processing chamber impact conditions proximate to the substrate, and have an effect on performance (e.g., target substrate properties, consistency of production, etc.). In some embodiments, components of the processing chamber may experience harsh or damaging environments. Coating components in a resistant material may protect them from wear and/or damage due to these environments.

In processing and/or manufacturing systems, many components performing various functions are in contact with a processing atmosphere. The processing atmosphere may contain corrosive materials, such as corrosive gas. The processing atmosphere may cycle between gases including multiple materials, including one or more corrosive materials. The processing atmosphere may experience extreme temperatures. The processing atmosphere may cycle between temperatures, such as cycling between elevated and room temperature during processing, between process operations, or the like.

Components of the processing system are composed of materials selected for the role of the component. In addition to material properties appropriate for the function of the component, properties related to the conditions experienced by the component are considered in design and manufacture of processing system components. Components may be used to carry gases, generate plasma, support a substrate, transport a substrate, conduct heat, conduct electricity, or perform any of a variety of other functions to support processing procedures. Components may also be designed to resist mechanical stress. For example, a substrate support stack may include components of the stack that support other components, components may resist damage from motion or wear, etc.

In some processes, components of a processing system or process chamber may provide a path for electric current to flow. A process chamber may be configured to perform an etch process, to etch one or more features or patterns into a substrate. A process chamber may be configured to generate plasma for processing. Generation and application of plasma may be augmented by maintaining a flow of electrical current through one or more components of a process chamber. Grounding straps may be utilized to maintain a path for flow of current between components, such as between a substrate support and a body of a process chamber.

In some systems, a substrate support may be moveable, e.g., may move up and down for holding substrates at different distances from a showerhead, for ease of loading and/or unloading substrates, etc. A substrate support may be grounded, e.g., there may be one or more components which provide a flow path for an electric current form the substrate support to the body of the process chamber. The grounding of the substrate support may be performed by including one or more grounding straps. Grounding straps may include flexible conductors that provide a path for electric current to flow between the substrate support and the body of the process chamber or another component. Grounding straps may be or include ribbons of metallic material.

Grounding devices may be constructed to withstand the conditions expected in a process chamber. For example, grounding devices may be constructed to withstand a heated, corrosive environment. These restrictions, along with electrical conductivity, mechanical stability, and flexibility features, limit design and construction options for some grounding devices. In some conventional systems, a pure aluminum may be used for a grounding strap. Pure aluminum conducts electricity sufficiently, but may not have the mechanical strength to resist damage in normal use, particularly at an elevated temperature (e.g., above 300° C.). In some conventional systems, an alloy of aluminum may be used for a grounding strap. Alloys of aluminum may increase mechanical strength, including at elevated temperatures, but may lack the corrosion resistance of pure aluminum (e.g., to corrosive gasses such as nitrogen trifluoride, $NF_3$). Other metals, such as steel or nickel, may have similar deficiencies.

In some systems, a grounding strap may include a metal core coated with a protective inert layer such as ceramic. For example, a steel core may be coated with a protective layer of alumina, $Al_2O_3$. Alumina or another protective coating may provide corrosion resistance to the core. In some systems, a layered component may become susceptible to failure over time. For example, layers of a grounding device may separate from each other, particles may be generated that interfere in processing operations, grounding devices may break (severing a flow path for electric current), etc.

Devices and methods of the present disclosure may address at least some of the deficiencies with conventional systems. The current disclosure enables a multi-layered grounding device, such as a grounding strap. The grounding device may be secured between a substrate support and a process chamber body. The grounding device may include a core material and an outer material. The grounding device may include one or more intermediate materials. The outer material may comprise pure aluminum.

In some embodiments, the core material may include an alloy of aluminum. In some embodiments, the core material may include a flexible ceramic, such as an alumina or zirconia ribbon. In some embodiments, the core material may include a flexible carbon, such as a ribbon of carbon fiber. In some embodiments, the core material may include a metal that is not an alloy of aluminum, such as a stainless steel or nickel. In some embodiments, the layered grounding device may include one or more intermediate layers. Intermediate layers may serve to improve adhesion between the core layer and the outer layer. Intermediate layers may serve to decrease a mismatch of thermal expansion between adjacent layers. Intermediate layers may serve to decrease a mismatch of coefficient of thermal expansion (CTE) between layers. In some embodiments, the outer layer may be deposited by physical vapor deposition. In some embodiments, intermediate layers may be deposited by physical vapor deposition. In some embodiments, outer and/or intermediate layers may be deposited by sputtering, e.g., sputtering of pure aluminum.

Devices, systems, and methods of the current disclosure provide technical advantages over conventional analogues. Pure aluminum may provide high resistance to corrosive environments. Pure aluminum may provide high resistance to $NF_3$ environments, even at elevated temperatures. Depositing pure aluminum on a core of a different material may mitigate operational deficiencies of pure aluminum as a grounding device, such as mechanical strength of the material. Grounding devices of multi-layer construction may have an increased tensile strength compared to single-layer (e.g., single alloy) construction. Grounding devices of multi-layer construction may have an increased yield strength compared to single-layer construction. Grounding devices of multi-layer construction may have increased lifetimes compared to conventional counterparts. Increased lifetime of grounding devices (e.g., grounding straps) may increase productive time (e.g., green time) of a process chamber. Increased lifetime of grounding devices may decrease the frequency of maintenance operations, decrease the cost of replacing grounding devices, etc. Increased lifetime of grounding devices may improve operation of the chamber. For example, multiple grounding straps may be used to provide sufficient flow paths for electric current between components of a process chamber. As grounding straps fail, operation of the process chamber may change, potentially in an unpredictable manner. The process chamber in some cases may still be usable, but with somewhat inconsistent or undesirable results. Reducing the likelihood of grounding devices failing may maintain a chamber's preferred operational conditions for a longer span of time. If a process chamber performs in an unexpected way (e.g., as induced by wear or damage to one or more grounding devices), substrates processed in the chamber may exhibit unintended properties. Substrates processed in the chamber may not meet performance thresholds, such as threshold metrology values. Increasing reliability and lifetime of grounding devices may decrease the cost associated with producing (e.g., in terms of materials expended, gas expended, time expended, chamber wear and/or aging, energy expended, etc.) and disposing of defective products.

In one aspect of the present disclosure, a grounding strap for a process chamber includes a core layer and an outer layer. The core layer may be comprised of a first material and the outer layer may be comprised of aluminum. The outer layer may be comprised of at least 99% pure aluminum.

In another aspect of the present disclosure, a process chamber includes a chamber body. The process chamber further includes a substrate support. The process chamber further includes a grounding device, coupled to the chamber body and the substrate support. The grounding device includes a core layer. The grounding device further includes an outer layer. The outer layer comprises at least 99% aluminum.

In another aspect of the present disclosure, a method includes providing a grounding device for application of an outer coating. The method further includes depositing an outer layer on the grounding device. The outer layer comprises at least 99% aluminum.

FIG. 1 is a sectional view of a processing chamber 100 including multi-layered grounding devices, according to some embodiments. Processing chamber 100 may be used for processes in which components of processing chamber 100 carry high amounts of electrical energy, such as large currents, voltages, etc. Processing chamber 100 may be used for processes in which a corrosive plasma environment (e.g., plasma processing conditions) is provided. For example, the processing chamber 100 may be a chamber for a plasma etcher or plasma etch reactor, a plasma cleaner, and so forth. Processing chamber 100 may be used to introduce a corrosive gas to a substrate for processing, such as $NF_3$. Examples of chamber components that may be including in processing chamber 100 include a substrate support assembly 104, an electrostatic chuck (ESC), a ring (e.g., a process kit ring or single ring), a chamber wall, a base, a gas distribution plate, a showerhead 106, a nozzle, a lid, a liner, a liner kit, a shield, a plasma screen, a flow equalizer, a cooling base, a chamber viewport, a chamber lid, and so on. Processing chamber 100 may be a semiconductor processing chamber.

As illustrated, the substrate support assembly 104 includes grounding devices 136 (e.g., grounding straps). Grounding devices 136 may be anchored to a portion of substrate support assembly 104 (e.g., a susceptor). Grounding devices 136 may be anchored to a grounded portion of processing chamber 100, such as the chamber body 108, sidewall 112, bottom 114, etc. Grounding devices 136 may provide a flow path for electric current. Grounding devices 136 may be flexible, e.g., to allow the substrate support assembly 104 to move relative to chamber body 108 while maintaining a flow path for electric current.

Grounding devices 136 may be multi-layered grounding devices. Grounding devices 136 may include a core layer and an outer layer. Grounding devices 136 may include one or more intermediate layers. The outer layer may be of pure aluminum, e.g., 99% pure aluminum, 99.9% pure aluminum, 99.99% pure aluminum, or other high purity aluminums. The core layer of grounding devices 136 may be of an alloy of aluminum, such as an aluminum-manganese alloy, a silicon-containing alloy, or the like. The core layer may be of another metallic composition, such as steel or nickel. The core layer may be a flexible ceramic, such as alumina or zirconia ribbon. The core layer may be of flexible carbon, such as carbon fiber.

In one embodiment, processing chamber 100 includes a chamber body 108 and a showerhead 106 that enclose an interior volume 110. The showerhead may include a showerhead base and a showerhead gas distribution plate. Alternatively, the showerhead 106 may be replaced by a lid and a nozzle in some embodiments. The chamber body 108 may be fabricated from aluminum, stainless steel or other suitable material. The chamber body 108 generally includes sidewalls 112 and a bottom 114.

An exhaust port 116 may be defined in the chamber body 108, and may couple the interior volume 110 to a pump system 118. The pump system 118 may include one or more pumps and throttle valves utilized to evacuate and regulate the pressure of the interior volume 110 of processing chamber 100.

Showerhead 106 may be supported on the sidewall 112 of the chamber body 108. The showerhead 106 (or lid) may be opened to allow access to the interior volume 110 of processing chamber 100, and may provide a seal for processing chamber 100 while closed. A gas panel 120 may be coupled to processing chamber 100 to provide process and/or cleaning gases to the interior volume 110 through showerhead 106 or lid and nozzle. Showerhead 106 is used for processing chambers used for dielectric etch (etching of dielectric materials). The showerhead 106 includes a gas distribution plate (GDP) having multiple gas delivery holes throughout the GDP. Showerhead 106 may include the GDP bonded to an aluminum base or an anodized aluminum base. The GDP may be made from Si or SiC, or may be a ceramic such as $Y_2O_3$, $Al_2O_3$, YAG, and so forth. The processing chamber may further include one or more heaters, e.g., for elevating a temperature of the process chamber, elevating a temperature of a substrate undergoing processing, maintaining a temperature of a substrate, a process chamber, or a process environment, etc. The processing chamber may be configured to reach and/or maintain a target temperature. The processing chamber may be configured to reach and/or maintain a target temperature at which some materials have reduced performance. The processing chamber may be configured to reach and/or maintain a target temperature at which aluminum has reduced strength. The processing chamber may be configured to reach and/or maintain a target temperature of at least 300° C.

For processing chambers used for conductor etch (etching of conductive materials), a lid may be used rather than a showerhead. The lid may include a center nozzle that fits into a center hole of the lid. The lid may be a ceramic such as $Al_2O_3$, $Y_2O_3$, YAG, or a ceramic compound comprising $Y_4Al_2O_9$ and a solid-solution of $Y_2O_3$—$ZrO_2$. The nozzle may also be a ceramic, such as $Y_2O_3$, YAG, or the ceramic compound comprising $Y_4Al_2O_9$ and a solid-solution of $Y_2O_3$—$ZrO_2$. The lid, showerhead base, GDP and/or nozzle may be coated with an arcing and plasma resistant coating layer.

Examples of processing gases that may be used to process substrates in the processing chamber 100 include halogen-containing gases, such as $C_2F_6$, $SF_6$, $SiCl_4$, HBr, $NF_3$, $CF_4$, $CHF_3$, $CH_2F_3$, F, $NF_3$, $Cl_2$, $CCl_4$, $BCl_3$ and $SiF_4$, among others, and other gases such as $O_2$, or $N_2O$. Examples of carrier gases include $N_2$, He, Ar, and other gases inert to process gases (e.g., non-reactive gases). The substrate support assembly 104 is disposed in the interior volume 110 of the processing chamber 100 below the showerhead 106 or lid. The substrate support assembly 104 holds the substrate 102 during processing. A ring (e.g., a single ring) may cover a portion of the support assembly 104 (e.g., susceptor 122), and may protect the covered portion from exposure to plasma during processing. The ring may be silicon or quartz in one embodiment. Substrate support assembly 104 may include a pedestal 124, and a susceptor 122.

Figure 2A:
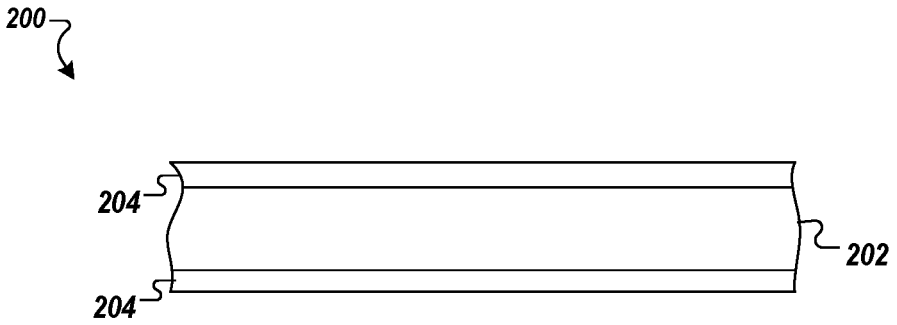
FIG. 2A illustrates a section of a grounding device including a core layer and an outer layer, according to some embodiments.
Figure 2B:
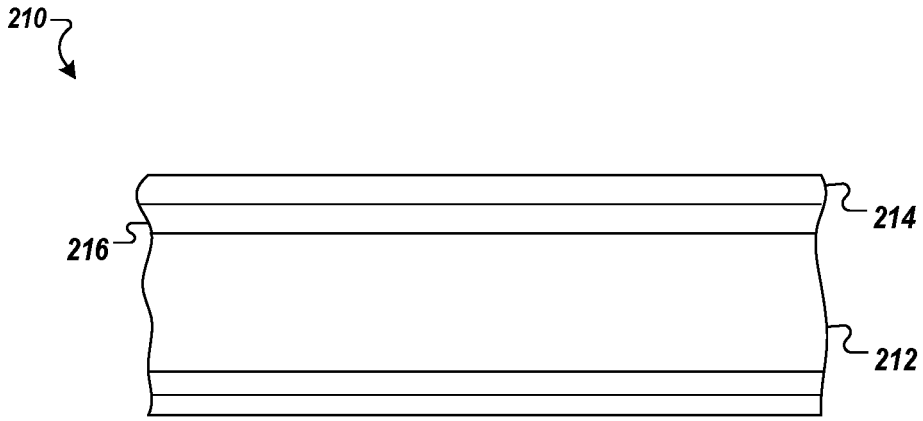
FIG. 2B illustrates a section of a grounding device including a core layer, an outer layer, and an intermediate layer.

FIGS. 2A-B depict sectional views of exemplary grounding devices, according to some embodiments. FIG. 2A illustrates a section of a grounding device 200 including core layer 202 and outer layer 204. Core layer 202 may be a body of any of various materials. Core layer 202 may be of a material that provides mechanical strength to the grounding device, e.g., a material capable of maintaining strength through repeated motion, bending, etc. The body (e.g., core layer 202) may be made from a metal (such as an aluminum alloy, stainless steel, nickel, etc.), a ceramic, a metal-ceramic composite, a polymer, a polymer ceramic composite, carbon, or other suitable materials. Core layer 202 may comprise a flexible ceramic material.

In some embodiments, an outer layer 204 applied directly to core layer 202 may be composed of aluminum. Outer layer 204 may be composed of substantially pure aluminum, e.g., at least 99% pure aluminum, at least 99.9% pure aluminum, at least 99.99% pure aluminum, or another grade of purity of aluminum. In some embodiments, outer layer 204 may cover core layer 202, e.g., may cover all sides and/or all surfaces of core layer 202. Outer layer 204 may protect core layer 202 from the surrounding environment, including a corrosive environment, a plasma environment, or the like. Outer layer 204 may be deposited by physical vapor deposition, chemical vapor deposition, ion assisted deposition, or any other method appropriate for depositing a thin layer of material on a body. Outer layer 204 may be deposited by sputtering. Grounding device 200 may be of a variety of shapes, such as a ribbon, a cord or wire, etc. Outer layer 204 may be a thin layer. Outer layer 204 may be around 15 μm thick, e.g., between 10 and 20 μm thick. Outer layer 204 may be between 100 nm and 100 μm, between 1 μm and 100 μm, between 5 μm and 50 μm, or any included range of any of these. Outer layer 204 may have a thickness between 1 μm and 100 μm. The core layer 202 and outer layer 204 may be of different chemical compositions, different alloys, different metals, different materials, etc.

Coating a core layer material with a protective aluminum coating may provide benefits to the operation and use of a grounding device, such as a grounding strap. The grounding device may benefit, for example, from corrosion resistance of the outer layer and strength of the core layer. In some embodiments, material of core layer 202 may be selected based on strength of the material. Material of core layer 202 may be selected to meet a threshold strength condition. Material of core layer 202 may be selected to meet a threshold yield strength, or the strength of a material before permanent deformation. Material of core layer 202 may be selected to meet threshold tensile strength, or the strength withstood by the material before fracture. Material of core layer 202 may be selected based on a different measure of strength, toughness, flexibility, etc.

A grounding device including an outer layer 204 of pure aluminum may have a strength larger than pure aluminum. A grounding device may have tensile strength greater than 100 megapascals (MPa). A grounding device may have a tensile strength greater than 150 MPa. A grounding device may have a tensile strength greater than 200 MPa, greater than 300 MPa, greater than 500 MPa, etc., depending for example on a material of core layer 202. A grounding device including an outer layer 204 of pure aluminum may have a yield strength greater than pure aluminum. The grounding device may have a yield strength greater than 50 MPa. The grounding device may have a yield strength greater than 70 MPa, greater than 100 MPa, greater than 150 MPa, greater than 200 MPa, greater than 300 MPa, greater than 400 MPa, etc. These strengths may be measure at room temperature. Material may be selected based on strengths at room temperature, elevated temperature, proposed processing temperature, etc.

The grounding device 200 (and/or other/additional grounding devices) may be installed in a process chamber. Installing the grounding device 200 in a process chamber may include affixing portions of grounding device 200 to components of the process chamber. Installing grounding device 200 in a process chamber may include forming via the grounding device a path for electricity to flow. Installing grounding device 200 may include affixing a portion of grounding device 200 to a substrate support, a susceptor, a plasma generation device, a portion of a chamber where charge collects, or the like. Installing grounding device 200 may include affixing a portion of grounding device 200 to a charge sink, such as a body of the process chamber.

FIG. 2B illustrates a section of a grounding device 210 including core layer 212, outer layer 214, and intermediate layer 216. Core layer 212, outer layer 214, and intermediate layer 216 may each be of different materials, different compositions, different alloys, etc. Core layer 212 may share one or more features with core layer 202 of FIG. 2A. Core layer 212 may be of a material exhibiting a target mechanical strength. Core layer 212 may be of an alloy of aluminum, a stainless steel, nickel, ceramic, carbon, or another material. Outer layer 214 may share one or more features with outer layer 204 of FIG. 2A. Outer layer 214 may be pure aluminum.

Grounding device 210 includes one or more intermediate layers 216, disposed between core layer 212 and outer layer 214. Intermediate layers 216 may improve adhesion between core layer 212 and outer layer 214. For example, intermediate layer 216 may adhere more robustly to both core layer 212 and outer layer 214 than the materials of core layer 212 and outer layer 214 adhere to each other. Adhesion may be improved by selection of materials for each layer. Intermediate layers 216 may be selected to reduce mismatches of thermal expansion at interfaces between layers. For example, intermediate layer 216 may be of a material with a coefficient of thermal expansion between that of core layer 212 and outer layer 214. In some embodiments, core layer 212 may be composed of a steel. Core layer 212 may be composed of a stainless steel. Intermediate layer 216 may be of titanium. Intermediate layer 216 may be of nickel. Outer layer 214 may be of pure aluminum.

Figure 3:
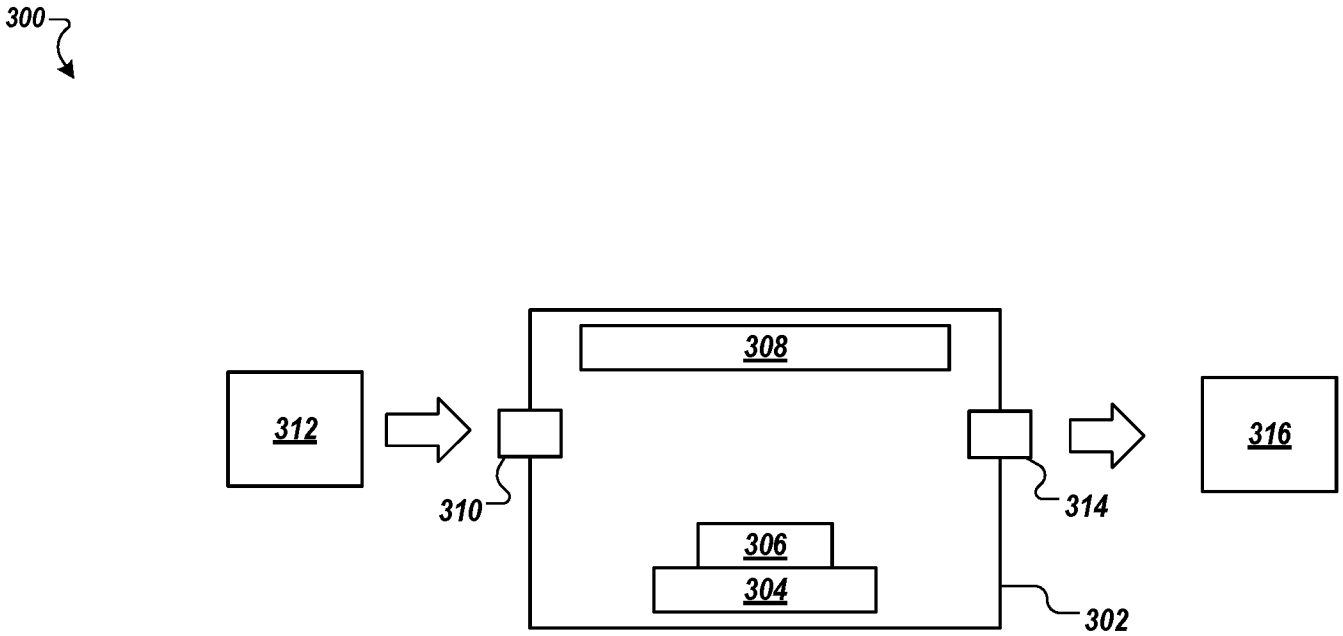
FIG. 3 is a diagram of an example architecture of a deposition system for performing sputtering deposition, according to some embodiments.

FIGS. 3-4 depict a few methods of applying coatings to a component, according to some embodiments. FIGS. 3-4 depict variations of physical vapor deposition. Other forms of physical vapor deposition may be used to deposit a coating on a grounding device. Other techniques (e.g., techniques different than physical vapor deposition) may be used to deposit a coating on a grounding device, in some embodiments.

FIG. 3 depicts an example architecture of a deposition system 300 for performing sputtering deposition, according to some embodiments. Deposition system 300 may be utilized to deposit a coating on a grounding device, such as a grounding device for a process chamber. Deposition system 300 may be utilized to deposit a coating of pure aluminum onto a core layer of a grounding device.

System 300 includes deposition chamber 302. For sputtering deposition, deposition chamber 302 may be maintained at reduced pressure, e.g., vacuum conditions. Deposition chamber 302 may include stage 304 for mounting a component to be coated. Grounding device 306 is to be coated by a protective coating (e.g., pure aluminum) via sputtering in deposition chamber 302. Deposition chamber 302 also includes sputtering target 308. Sputtering target 308 may be of a material that is to coat grounding device 306, e.g., pure aluminum.

Deposition chamber 302 may be coupled, via exhaust port 314, to a pumping system 316. Pumping system 316 may reduce pressure inside deposition chamber 302, may generate a vacuum within chamber 302, may carry gases introduced or generated during deposition away from chamber 302, etc. Pumping system 316 may include any pumps, valves, chambers, lines, etc., for use in achieving and maintaining target pressures and/or flow rates in deposition chamber 302.

Deposition chamber 302 may be coupled via input port 310, to sputtering gas supply system 312. Sputtering gas supply system 312 may include any chamber, valves, lines, etc., for introduction of sputtering gas to deposition chamber 302. Sputtering gas may include inert gas, such as neon, argon, krypton, xenon, etc. Sputtering gas supply system 312 may generate gaseous ions, e.g., argon ions for sputtering. Ions may be generated via plasma generation, e.g., radio frequency plasma generation.

Sputtering gas may be accelerated at sputtering target 308. Ions may be accelerated utilizing electric and/or magnetic fields towards target 308. As high energy particles impact target 308 (e.g., ions of sputtering gas), material (e.g., pure aluminum) is liberated from target 308 and travels through deposition chamber 302 to be deposited on grounding device 306. Sputtering may continue until layer of coating material may be deposited on grounding device 306 of a target thickness, e.g., between 10 and 20 μm thick. Different thicknesses of layers may be deposited on grounding device 306. Grounding device 306 may be of a variety of materials, e.g., an aluminum alloy, a stainless steel, nickel, flexible ceramic, flexible carbon, etc.

Figure 4A:
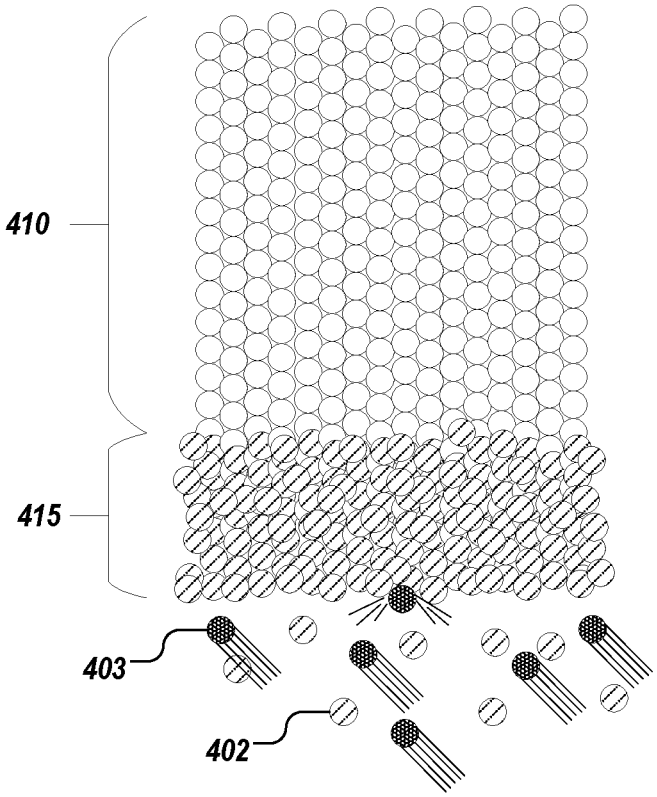
FIG. 4A depicts a deposition mechanism applicable to deposition techniques utilizing energetic particles, such as ion assisted deposition, according to some embodiments.
Figure 4B:
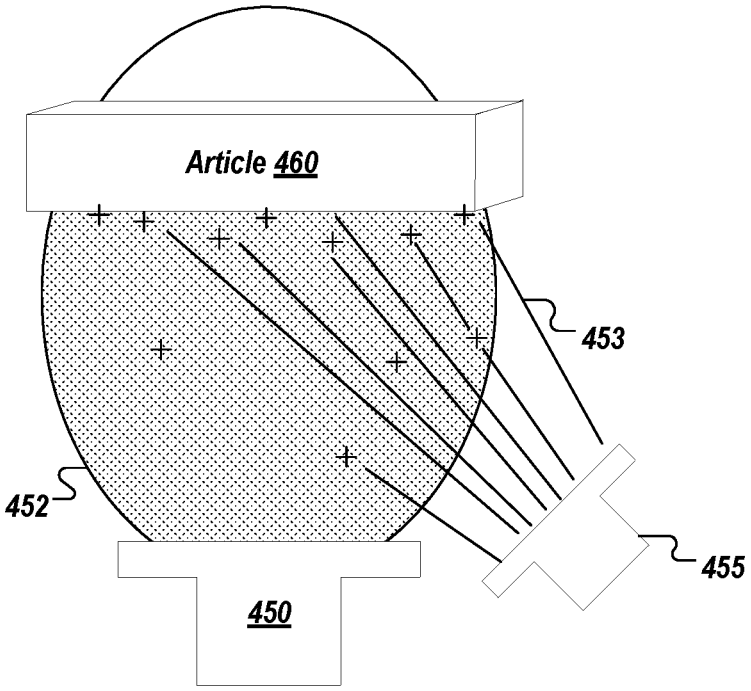
FIG. 4B is a schematic diagram of an ion assisted deposition apparatus, according to some embodiments.

FIGS. 4A-B depict a mechanism and apparatus for performing deposition techniques utilizing energetic particles, according to some embodiments. FIG. 4A depicts a deposition mechanism applicable to a variety of deposition techniques utilizing energetic particles such as ion assisted deposition (IAD). Exemplary IAD methods include deposition processes which incorporate ion bombardment, such as evaporation (e.g., activated reactive evaporation (ARE)) and sputtering in the presence of ion bombardment to form coatings as described herein. Any of the IAD methods may be performed in the presence of a reactive gas species, such as $O_2$, $N_2$, halogens, etc.

As shown, a thin coating layer 415 is formed by an accumulation of deposition materials 402 in the presence of energetic particles 403 such as ions. The deposition materials 402 include atoms, ions, radicals, or their mixture. The energetic particles 403 may impinge and compact the thin final protective coating layer 415 as it is formed. The coating layer may be of pure aluminum. The coating layer may provide protection from a harsh environment to a grounding device (e.g., grounding device 410). The coating layer may provide protection to grounding device 410 from corrosive gas environments of a substrate process chamber.

In one embodiment, IAD is utilized to form a thin coating layer 415. FIG. 4B depicts a schematic of an IAD deposition apparatus. As shown, a material source 450 provides a flux of deposition materials 452 for deposition on article 460 while an energetic particle source 455 provides a flux of the energetic particles 453, both of which impinge upon the article 460 throughout the IAD process. The energetic particle source 455 may be an oxygen or other ion source. The energetic particle source 455 may also provide other types of energetic particles such as inert radicals, neutron atoms, and nano-sized particles which come from particle generation sources (e.g., from plasma, reactive gases or from the material source that provide the deposition materials). IAD may utilize one or more plasmas or beams to provide the material and energetic ion sources. Reactive species may also be provided during deposition of the plasma resistant coating. Deposition materials 452 may be atoms of pure aluminum for coating a grounding device for use in a substrate processing chamber.

With IAD processes, the energetic particles 453 may be controlled by the energetic ion (or other particle) source 455 independently of other deposition parameters. According to the energy (e.g., velocity), density and incident angle of the energetic ion flux, composition, structure, crystalline orientation and grain size of the thin film protective layer may be manipulated. Additional parameters that may be adjusted are a temperature of the article during deposition as well as the duration of the deposition. The ion energy may be roughly categorized into low energy ion assist and high energy ion assist. The ions are projected with a higher velocity with high energy ion assist than with low energy ion assist. In general superior performance has been shown with high energy ion assist. Substrate (article) temperature during deposition may be roughly divided into low temperature (around 120-150° C. in one embodiment which is typical room temperature) and high temperature (around 270° C. in one embodiment).

Figure 5:
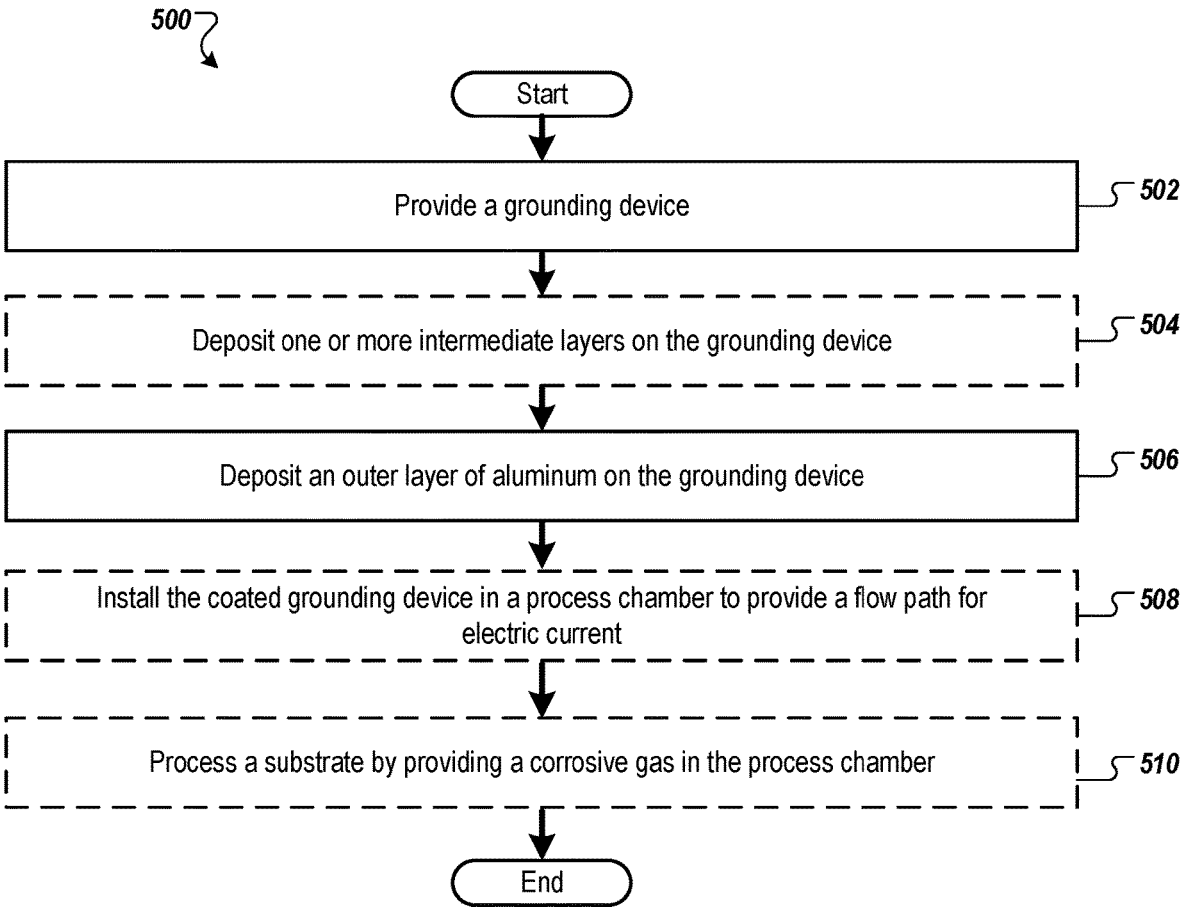
FIG. 5 is a flow diagram of a method for manufacturing and using a coated grounding device, according to some embodiments.

FIG. 5 is a flow diagram of a method 500 for manufacturing and using a coated grounding device, according to some embodiments. At block 502 a grounding device is provided. The grounding device may be a flexible device. The grounding device may be of a core material, e.g., a material that will form the core of the coated grounding device. The grounding device may be a grounding strap. The grounding device may comprise an aluminum alloy, a steel, another metal or metal alloy such as nickel, a ceramic (e.g., a flexible ceramic ribbon), a flexible carbon, etc. The grounding device may be provided to an apparatus for applying a coating, such as a physical vapor deposition chamber.

At block 504, one or more intermediate layers are optionally deposited on the grounding device. Deposited layers may be applied to substantially cover the grounding device, e.g., to protect the grounding device from a surrounding corrosive environment during use of the grounding device. Intermediate layers may aid in adhesion of layers of the grounding device. Intermediate layers may be of materials selected to reduce one or more differences between coefficients of thermal expansion of materials at interfaces between layers.

At block 506, an outer layer is deposited on the grounding device. The outer layer may be of pure aluminum. The outer layer may protect the grounding device during substrate processing. The outer layer may extend a lifetime of the grounding device, e.g., from weeks or months (in the case of aluminum alloy, including vulnerable materials to corrosive gases) to months or years.

Blocks 508 and 510 describe usage of a coated grounding device. At block 508, the coated grounding device in installed in a process chamber. The grounding device may be installed in a process chamber that is used to expose a substrate to a corrosive environment. The grounding device may be installed in a process chamber that processes at elevated temperature. The grounding device may be installed in an etch chamber. The grounding device may be installed in a chamber that utilizes $NF_3$. The grounding device may provide a flow path for electric current. The grounding device may be affixed to a component of the process chamber that may accumulate electric charge. The grounding device may be coupled to ground, e.g., by being affixed to the body, floor, or sidewall of the process chamber. The grounding device may provide an electric current flow path from a portion of a substrate support assembly, such as a susceptor, to the process chamber body.

At block 510, a substrate is processed in the processing chamber that includes the coated grounding device. The processing chamber may include multiple coated grounding devices, e.g., an array of grounding devices. The substrate processing may include introduction of a corrosive gas, elevation of temperature, generation of plasma, etc.

The preceding description sets forth numerous specific details such as examples of specific systems, components, methods, and so forth, in order to provide a good understanding of several embodiments of the present disclosure. It will be apparent to one skilled in the art that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular implementations may vary from these exemplary details and still be contemplated to be within the scope of the present disclosure.

Preceding descriptions refer to applying coatings to various components, bodies, articles, etc. In some cases, a coating or layer is described as being applied "on" or "onto" a body, layer, material, etc. Unless clear from the context, a layer described as being "on" a layer, body, component, material, etc., may not be directly adjacent to what the layer is on, and there may be an intervening layer of another material between.

Reference throughout this specification to "one embodiment" or "an embodiment" means that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or." When the term "about" or "approximately" is used herein, this is intended to mean that the nominal value presented is precise within ±10%.

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner.

It is to be understood that the above description is intended to be illustrative, and not restrictive. Many other embodiments will be apparent to those of skill in the art upon reading and understanding the above description. The scope of the disclosure should, therefore, be determined with reference to the appended claims, along with the full scope of equivalents to which such claims are entitled.

What is claimed is:

1. A grounding strap for a process chamber, comprising:

a core layer, wherein the core layer consists essentially of a ceramic ribbon, a polymer, a polymer ceramic composite, or a carbon fiber ribbon;

an intermediate layer, deposited on the core layer; and an outer layer deposited on the intermediate layer, wherein the outer layer comprises at least 99% aluminum, and wherein the outer layer, core layer, and intermediate layer each comprise a different chemical composition.

2. The grounding strap of claim 1, wherein the outer layer comprises at least 99.9% aluminum.

3. The grounding strap of claim 1, wherein a value of a coefficient of thermal expansion (CTE) of a material of the intermediate layer is between a value of a CTE of a material of the core layer and a value of a CTE of a material of the outer layer.

4. The grounding strap of claim 1, wherein the outer layer has a thickness between 1 μm and 100 μm.

5. The grounding strap of claim 1, wherein the grounding strap has a yield strength at room temperature of at least 70 megapascals.

6. The grounding strap of claim 1, wherein the core layer consists essentially of an alumina or zirconia ribbon.

7. The grounding strap of claim 1, wherein the core layer consists essentially of carbon fiber.

* * * * *